United States Patent [19]

Jester

[11] Patent Number: 4,521,970

[45] Date of Patent: Jun. 11, 1985

[54] WATER BED SHEET ANCHORING APPARATUS

[76] Inventor: James M. Jester, 3530 Atoll, San Diego, Calif. 92111

[21] Appl. No.: 529,410

[22] Filed: Sep. 6, 1983

[51] Int. Cl.[3] ..... A44B 1/42; G01B 3/00

[52] U.S. Cl. ..... 33/180 R; 33/190; 24/90 R; 5/498

[58] Field of Search ..... 33/180 R, 190; 5/495, 5/498, 482; 24/90 R, 114.5

[56] References Cited

U.S. PATENT DOCUMENTS

| | | | |
|---|---|---|---|
| 1,362,434 | 12/1920 | Morgan | 24/90 R |
| 1,396,344 | 11/1921 | Romati | 24/90 R |
| 1,602,305 | 10/1926 | Helm | 5/498 |
| 1,833,298 | 11/1931 | Oakey | 5/498 |
| 2,558,966 | 7/1951 | Lane, Jr. | 33/190 |
| 3,092,848 | 6/1963 | Gronvold | 5/495 |

FOREIGN PATENT DOCUMENTS

| | | | |
|---|---|---|---|
| 727270 | 3/1955 | United Kingdom | 5/498 |

*Primary Examiner*—Willis Little

[57] ABSTRACT

An anchoring device for the sheet and/or other covers of a water bed includes a generally elongated rectangular, flat panel for positioning under a water bed mattress to be held in place by the weight of the mattress against the bed support platform and including an elongated slot for receiving a button secured to the corners of the sheets for retaining the sheet in place.

17 Claims, 6 Drawing Figures

FIG. 3
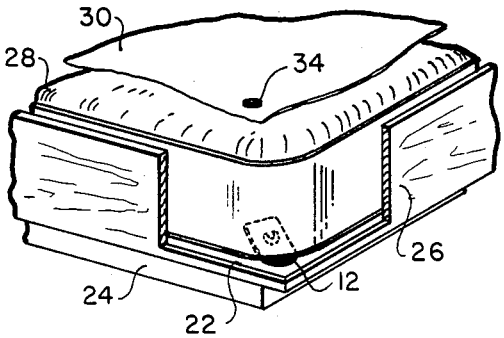
FIG. 1
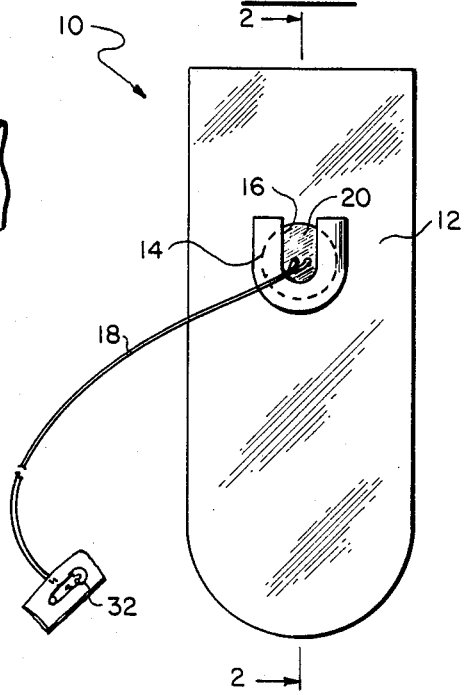
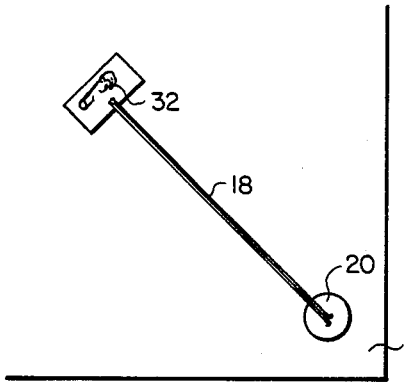
FIG. 5
FIG. 6
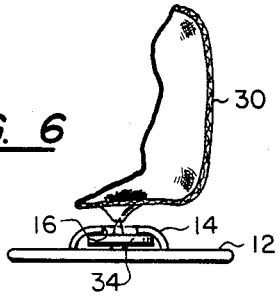
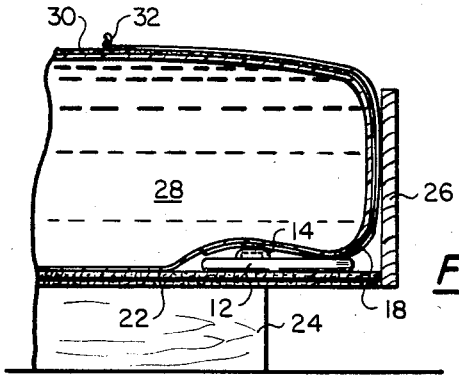
FIG. 4
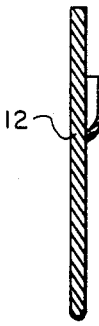
FIG. 2

WATER BED SHEET ANCHORING APPARATUS

BACKGROUND OF THE INVENTION

The present invention relates to anchoring devices and pertains particularly to an apparatus for anchoring a flexible sheet or the like on a water bed mattress.

Water beds which include a fluid filled, generally rectangular bladder supported on a support platform and surrounded by a retaining frame have become quite popular in recent years. Such mattress for water beds are typically covered with the usual sheets and other typical bedding material. One difficulty, however, is that it is difficult to retain these sheets and coverings in place without special fixtures for attachment of the sheets directly to the bed frame or the like. Because of the resiliency and give of the water bed mattress the coverings and sheets do not typically remain in place as easily as on a typical stuffed mattress. While many devices have been proposed for attaching the sheets to the bed frame, such attachments are not completely satisfactory. It is desirable that the sheets be hooked beneath the mattress in a typical fashion and/or tightened against the water bed mattress itself rather than from the supporting frame of the bed.

It is therefore desirable that an improved anchoring devices be available for water bed sheets and the like.

SUMMARY AND OBJECTS OF THE INVENTION

It is the primary object of the present invention to provide and improved anchoring apparatus for sheets and the like for covering a water bed mattress.

In accordance with the primary aspect of the present invention, an anchoring device for holding bed sheets on a water bed mattress includes a generally flat, rectangular panel having a button-receiving slot formed therein for receiving a button or the like attached to a sheet. The panel is adapted to rest on the platform of the water bed and be held in place by means of the water bed mattress.

BRIEF DESCRIPTION OF THE DRAWINGS

The above and other objects and advantages of the present invention will become apparent from the description when read in conjunction with the drawings where:

FIG. 1 is a top plan view of the anchoring device of the present invention;

FIG. 2 is a side elevation view in section taken generally along lines 2—2 of FIG. 1;

FIG. 3 is a perspective view in section showing the anchoring device in position in a water bed;

FIG. 4 is a side elevation view in section showing the device in position and attached to a sheet on a bed;

FIG. 5 is a top plan view showing the button positioning device in place; and FIG. 6 is an enlarged detail side elevation view showing the anchoring device with a sheet releaseably attached.

DETAILED DESCRIPTION OF A PREFERRED EMBODIMENT

Referring to FIG. 1 of the drawing there is illustrated a holder or anchoring device in accordance with the invention designated generally by the numeral 10 and comprising a generally rectangular flat panel 12 having a length on the order of about eight to ten inches and a width of on the order of three to six inches. The preferred size, however, is that suitable for fitting within a legal-sized envelope for ease of mailing for facilitating shipping.

The panel includes a button-receiving slot 14 formed in the upper surface thereof which slot may be formed in a slightly upwardly protruding projection from the upper surface thereof defining a pair of side rails to permit a button 20 to slide within the end beneath the side rails of the slot.

The button is attachable to the corner or edge of a sheet and when positioned in the slot which attaches the sheet in a releasable fashion to the holder. The anchoring or holding apparatus is preferably incorporated in a kit including a positioning device including an elongated strap 18 on one end of which is attached a suitable button 20 for fitting into the slot 14. This permits the button to be located on the sheet with respect to the water bed mattress to which it is to cooperate.

To further illustrate the use and function of the device, there is illustrated in FIG. 3 a typical water bed structure comprising a support platform 22 supported on support legs or pedestal structure 24 and including a peripheral frame 26. The frame 26 extends upward and extends around the periphery of the support platform 22 for containing a water bed mattress 28. The mattress is a typical, generally rectangular boxlike bladder of a suitable rubber or synthetic rubber material constructed, for example, of any of the suitable flexible polymer plastics on the order of several mils thick for containing a quantity of water. The mattress is preferably on the order of anywhere from eight to 12 inches in thickness when filled for supporting one or more mature adults.

In use, of the anchor or holder of the present invention a sheet 30 is selected and sized to the water bed mattress. The anchor device 12 is placed in the corner of the bed frame as shown in FIGS. 3 and 4 with the slot opening toward the center of the bed frame and the rounded corner of the holder extending toward the corner of the bed frame. This is placed beneath the mattress with the button 20 of the positioning device placed in the slot 16 and the tape 18 extending outward for access above the mattress and frame. A sheet 30 is placed in position on the mattress and the tape 18 pulled in a snug fashion to a position on the sheet and either pinned or attached such as by a safety pin 32 or other means to the sheet. The sheet is then removed from the edge of the water bed and the button on the strap as shown in FIG. 5 illustrates the position for the button on the sheet. A button of the appropriate size 34 is selected and sewn in position (where button 20 is shown in FIG. 5) on the sheet 30. Similar action positions the button for the other corner of the sheet.

With the button in place on the sheet, other sheets can be similarly equipped with buttons at the appropriate position by simply measuring and positioning from the first sheet. Thereafter, when sheets are to be placed on the bed the holder device 12 is tucked underneath the corner of the mattress at the corner of the frame and preferably positioned similar to that shown in FIGS. 3 and 4 extending toward the center of the bed frame. The sheets are then placed on the bed with the button slipped into a slot on the holder device 12 (FIG. 6). To remove the sheets, the corner of the mattress is raised slightly and a hand can be extended beneath the corner of the mattress and grasp the sheet and pull it toward the slot opening to remove the button 34 from the slot.

Any number of the holding or anchoring devices in accordance with the invention may be utilized as desired. The devices may also be utilized for holding mattress covers, blankets, sheets or any other bed covering in place with respect to a water bed mattress or any mattress. Any number of the holding devices may be utilized positioned at any desired position around the frame of the water bed or the like.

While I have illustrated and described my invention by means of specific embodiments, it is to be understood that numerous changes and modifications may be made therein without departing from the spirit and scope of the invention as defined in the appended claims.

What is claimed is:

1. A sheet holder for a water bed, comprising:

a generally thin flat panel having a top surface and a bottom surface;

an anchoring slot opening to the top and toward one end thereof defined by a pair of spaced apart rails wherein said slot and rails project above the top surface of said panel for overlapping and engaging the edges of a button.

2. The sheet holder of claim 1 in combination with a button locator for location of a button on a sheet for cooperative engagement with said anchoring slot.

3. The sheet holder of claim 1 wherein said panel is about three and one-half inches wide and about eight inches long with one rounded end.

4. The sheet holder of claim 3 wherein said slot opens away from said rounded end.

5. The sheet holder of claim 4 wherein said slot is disposed from about one-half to two-thirds the length of said panel from said rounded end.

6. A sheet holder for a water bed, comprising:

a generally thin flat panel having a top surface and a bottom surface;

an anchoring slot opening to the top and toward one end thereof defined by a pair of rails for overlapping and engaging the edges of a button wherein said slot and rails are formed within the space between said top surface and said bottom surface.

7. The sheet holder of claim 6 wherein said panel is about three and one-half inches wide and about eight inches long with one rounded end.

8. The sheet holder of claim 7 wherein said slot opens away from said rounded end.

9. The sheet holder of claim 8 wherein said slot is disposed from about one-half to two-thirds the length of said panel from said rounded end.

10. A sheet holder for a water bed, comprising:

a generally thin flat panel having a top surface and a bottom surface;

an anchoring slot opening to the top and toward one end thereof defined by a pair of rails for overlapping and engaging the edges of a button wherein said panel is about three and one-half inches wide and about eight inches long with one rounded end.

11. The sheet holder of claim 10 wherein said slot opens away from said rounded end.

12. The sheet holder of claim 11 wherein said slot is disposed about two-thirds the length of said panel from said rounded end.

13. A sheet holder for a water bed, comprising;

a generally thin flat panel having a top surface and a bottom surface;

an anchoring slot opening to the top and toward one end thereof for receiving a fastening button;

a button locator for location of a button on a sheet for cooperative engagement with said anchoring slot wherein said locator comprises an elongated flexible strap, and a button secured to one end of said strap.

14. The sheet holder of claim 13 wherein said anchoring slot is defined by a pair of spaced apart rails wherein said slot and rails project above the top surface of said panel for overlapping and engaging the edges of a button.

15. The sheet holder of claim 13 wherein said panel is about three and one-half inches wide and about eight inches long with one rounded end.

16. The sheet holder of claim 15 wherein said slot opens away from said rounded end.

17. The sheet holder of claim 16 wherein said slot is disposed from about one-half to two-thirds the length of said panel from said rounded end.

* * * * *